US006997397B1

(12) United States Patent
Keung et al.

(10) Patent No.: US 6,997,397 B1
(45) Date of Patent: Feb. 14, 2006

(54) TRIGGER SPRAYER NOZZLE

(75) Inventors: Wing-Kwong Keung, Perrysburg, OH (US); Martin S. Laffey, Sylvania, OH (US)

(73) Assignee: Continental AFA Dispensing Company, St. Peters, MO (US)

( * ) Notice: Subject to any disclaimer, the term of this patent is extended or adjusted under 35 U.S.C. 154(b) by 0 days.

(21) Appl. No.: 10/409,793

(22) Filed: Apr. 8, 2003

(51) Int. Cl.
*A62C 11/00* (2006.01)

(52) U.S. Cl. ..... 239/333; 239/391; 239/397; 239/537; 239/554; 222/553; 222/554

(58) Field of Classification Search ..... 239/333, 239/390–394, 397, 437, 504, 512, 537–539, 239/554; 222/553, 554
See application file for complete search history.

(56) References Cited

U.S. PATENT DOCUMENTS

| | | | | | |
|---|---|---|---|---|---|
| RE29,405 | E | * | 9/1977 | Gunzel et al. | 239/318 |
| 4,247,048 | A | | 1/1981 | Hayes | 239/396 |
| 4,706,888 | A | | 11/1987 | Dobbs | 239/478 |
| 4,779,803 | A | * | 10/1988 | Corsette | 239/428.5 |
| 4,944,460 | A | | 7/1990 | Steingass | 239/428.5 |
| 4,991,778 | A | | 2/1991 | Maas et al. | 239/333 |
| 5,234,167 | A | | 8/1993 | Martin | 239/343 |
| 5,267,692 | A | | 12/1993 | Maas et al. | 239/333 |
| 5,526,985 | A | | 6/1996 | Martin | 239/478 |
| 5,664,732 | A | | 9/1997 | Smolen, Jr. et al. | 239/121 |
| 5,704,550 | A | | 1/1998 | Foster et al. | 239/333 |
| 6,126,090 | A | * | 10/2000 | Wadsworth et al. | 239/333 |
| 6,446,882 | B1 | * | 9/2002 | Dukes et al. | 239/333 |

FOREIGN PATENT DOCUMENTS

| | | |
|---|---|---|
| WO | WO 89/09655 A1 | 4/1989 |

* cited by examiner

*Primary Examiner*—Thomas Denion
*Assistant Examiner*—Kyle M. Riddle
(74) *Attorney, Agent, or Firm*—Thompson Coburn LLP

(57) ABSTRACT

A trigger sprayer includes a sprayer body having a barrel with an internal passage, and a nozzle mounted over an open end of the barrel for rotation between dispensing and non-dispensing positions. The nozzle has a plug that is received in the open end of the barrel passage. The plug has laterally opening windows positioned for selective registry with an internal axial slot in the wall of the barrel passage adjacent to the open end of the barrel. The windows in the plug connect with fluid outlets in the nozzle. The nozzle is rotatable around the end of the barrel selectively for bringing the windows into registry with the slot in the barrel to dispense fluid from the end of the nozzle.

21 Claims, 8 Drawing Sheets

TRIGGER SPRAYER NOZZLE

The present disclosure is directed to trigger sprayers for dispensing liquids, and more particularly an improved sprayer nozzle for dispensing liquid in differing dispensing patterns.

BACKGROUND AND SUMMARY OF THE INVENTION

Trigger sprayers and packages of the subject type conventionally include a sprayer body with facility for mounting the body on the open end of a container. A trigger actuator is coupled to a pump mechanism within the sprayer body for manual activation by a user to draw liquid from within the container and direct the liquid along a passage in an outlet barrel on the sprayer body. A nozzle is mounted on the end of the barrel for rotation between one or more first positions for dispensing liquid from the passage in the barrel, and one or more second positions for blocking the dispensing of liquid. U.S. Pat. No. 5,664,732, for example, discloses a trigger sprayer in which the nozzle is rotatable between diametrically opposed "off" positions and diametrically opposed dispensing positions at 90° spacing from the "off" positions. The nozzle is adapted to dispense liquid in the form of a spray or a stream depending upon the selected dispensing position of the nozzle. A general object of the present invention is to provide a nozzle for a trigger sprayer that has improved flexibility in terms of varying the fluid dispensing patterns.

A trigger sprayer in accordance with one exemplary presently preferred embodiment of the invention includes a sprayer body having a barrel with an internal passage, and a nozzle mounted over an open end of the barrel for rotation between dispensing and non-dispensing positions. The nozzle has a plug that is received in the open end of the barrel passage. The plug has laterally opening windows positioned for selective registry with an internal axial slot in the wall of the barrel passage adjacent to the open end of the barrel. The windows in the plug connect with fluid outlets in the nozzle. The nozzle is rotatable around the end of the barrel selectively for bringing the windows into registry with the slot in the barrel to dispense fluid from the end of the nozzle.

BRIEF DESCRIPTION OF THE DRAWINGS

The invention, together with additional objects, features, advantages and aspects thereof, will be best understood from the following description, the appended claims and the accompanying drawings, in which:

DETAILED DESCRIPTION OF PREFERRED EMBODIMENTS

Figure 1:
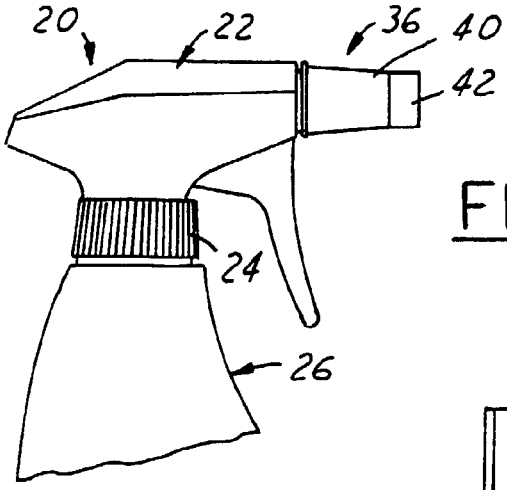
FIG. 1 is a fragmentary elevation view of a trigger sprayer equipped with a dispensing nozzle in accordance with one exemplary but presently preferred embodiment of the invention.
Figure 3:
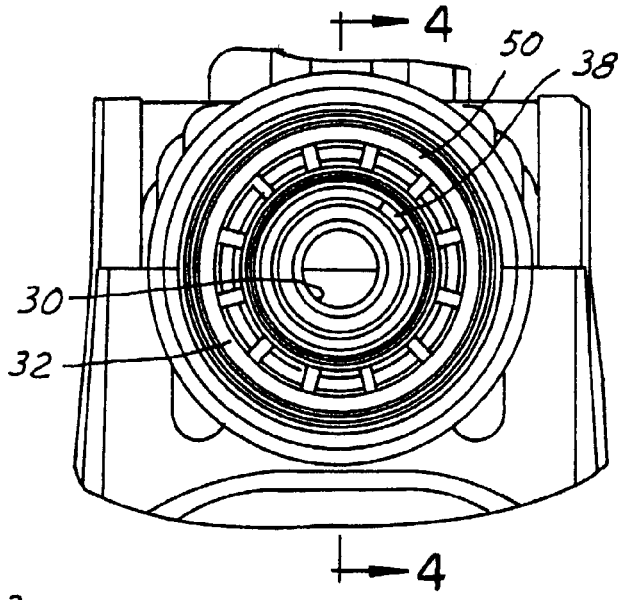
FIG. 3 is an elevational view of the open end of the barrel in the sprayer of FIGS. 1 and 2 with the nozzle removed.
Figure 2:
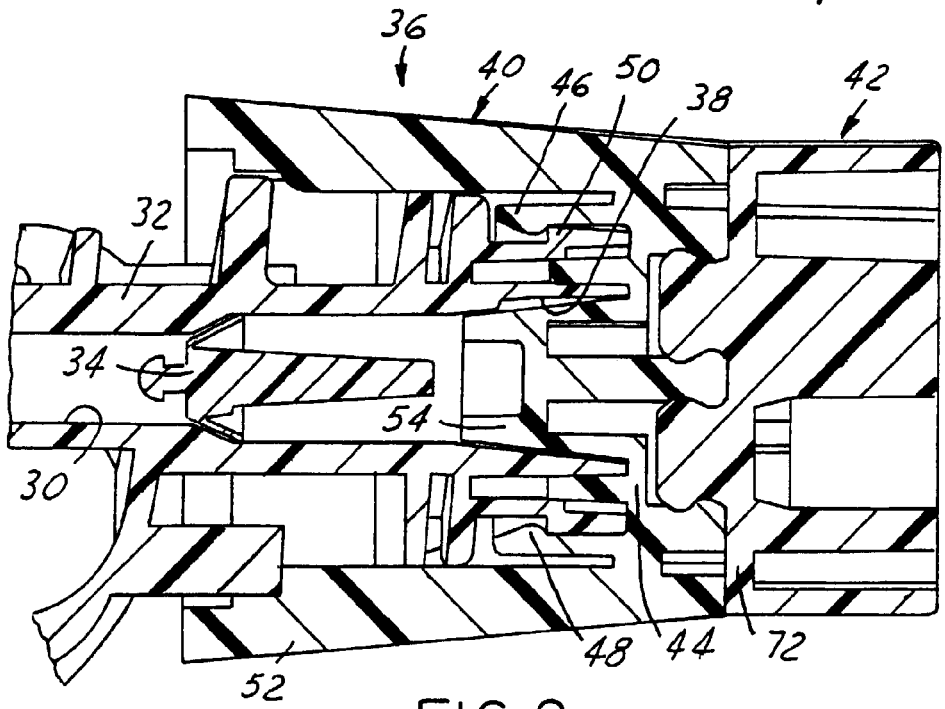
FIG. 2 is a fragmentary sectional view of the nozzle mounted on the end of the barrel in the sprayer of FIG. 1.
Figure 4:
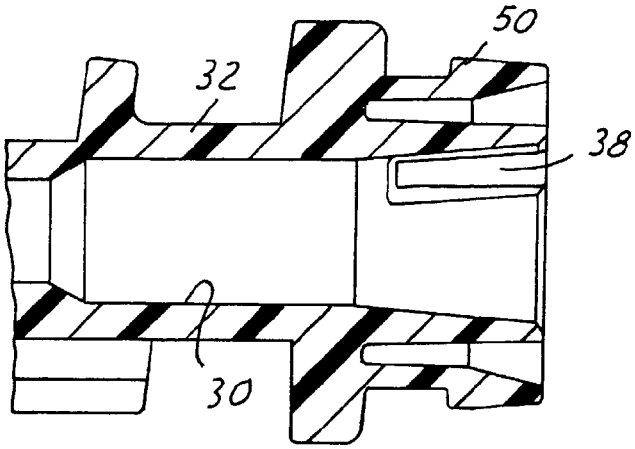
FIG. 4 is a fragmentary sectional view taken substantially along the line 4—4 in FIG. 3.
Figure 5:
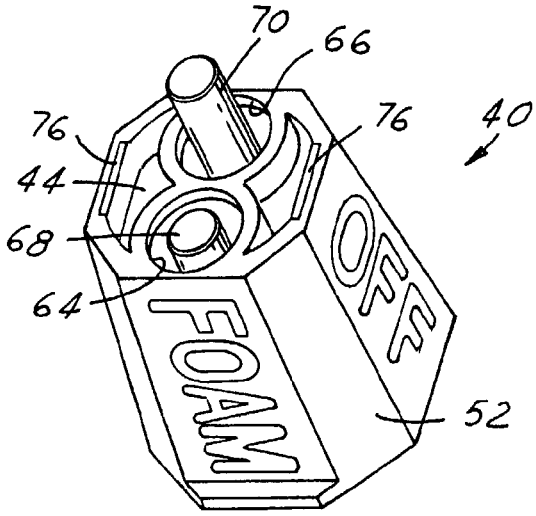
FIG. 5 is a perspective view of the nozzle body that forms part of the nozzle in the sprayer of FIGS. 1 and 2.
Figure 6:
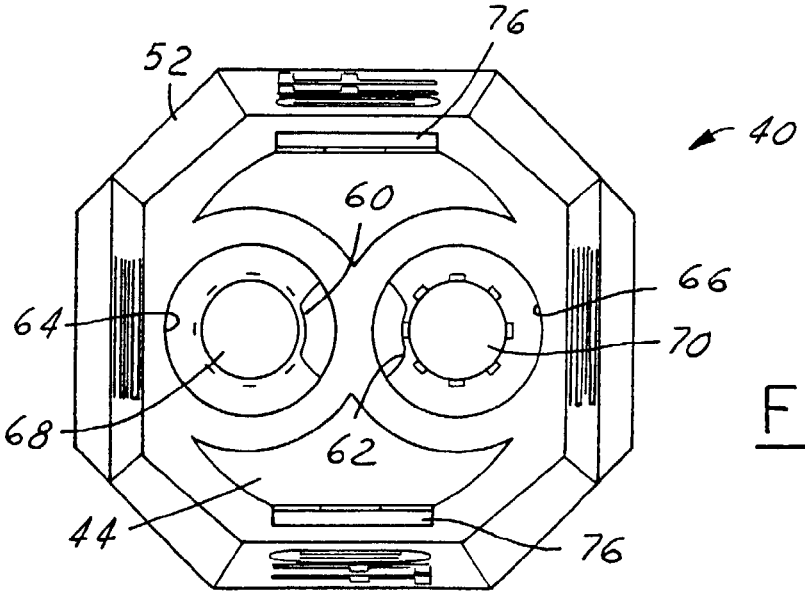
FIG. 6 is an elevational view of the outer end of the nozzle body in FIG. 5.
Figure 7:
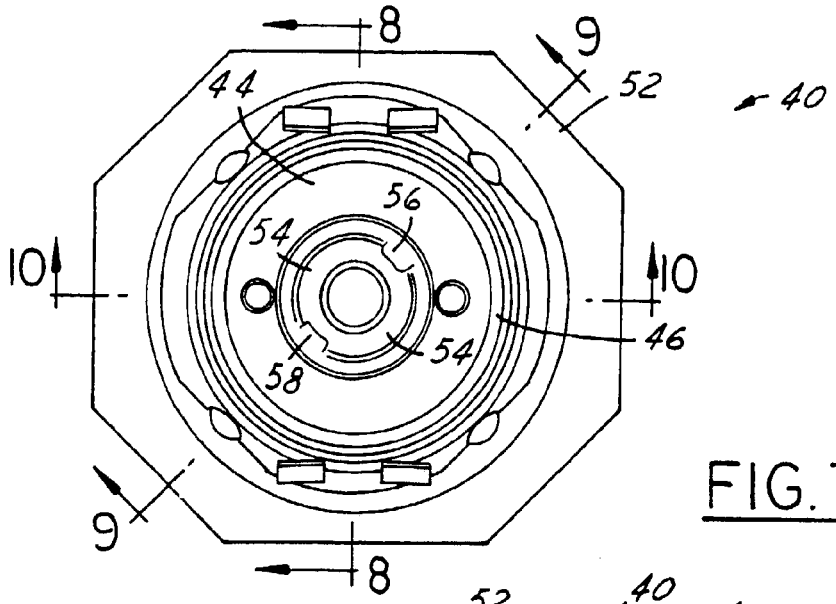
FIG. 7 is an elevational view of the inside of the nozzle body in FIG. 5.
Figure 8:
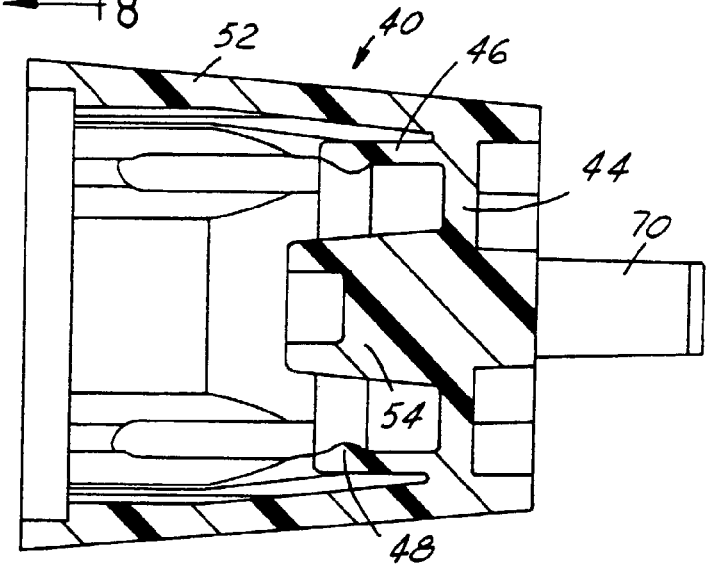
FIGS. 8, 9 and 10 are sectional views taken substantially along the respective lines 8—8, 9—9 and 10—10 in FIG. 7.

FIGS. 1 and 2 illustrate a trigger sprayer 20 in accordance with one presently preferred embodiment of the invention. A sprayer assembly 22 is mounted by a closure 24 to the open end of a liquid container 26. A trigger 28 is pivotally mounted on sprayer assembly 20 and coupled to an internal pump mechanism for feeding fluid under pressure through the outlet passage 30 of a barrel 32 (FIG. 2). A check valve 34 is mounted within barrel 32 to permit discharge of fluid but prevent return of fluid to container 26. A nozzle 36 is rotatably mounted to the end of barrel 32 for selectively dispensing fluid from the end of the barrel upon actuation of trigger 28. In accordance with the present invention, an axially extending slot 38 (FIGS. 2–4) is formed in the internal surface of barrel 32 adjacent to the open end of passage 30. This slot 38 extends radially into the wall of barrel 30, and axially along the internal surface of the barrel to the open end of the barrel, as best seen in FIGS. 2 and 4.

Figure 9:
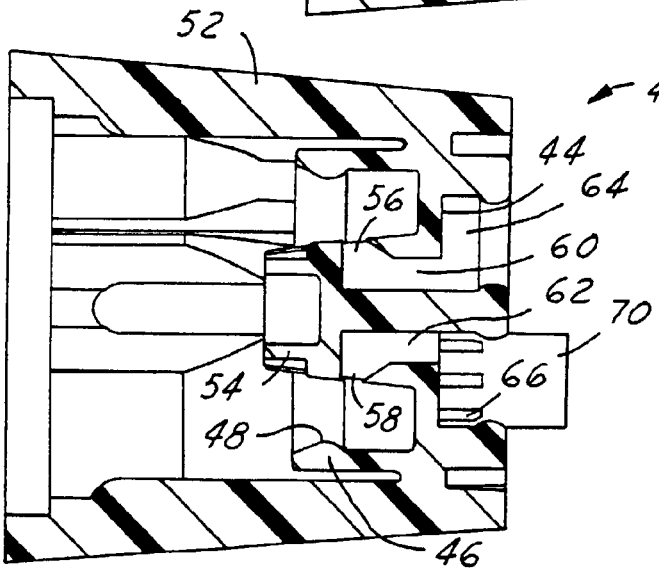
Figure 10:
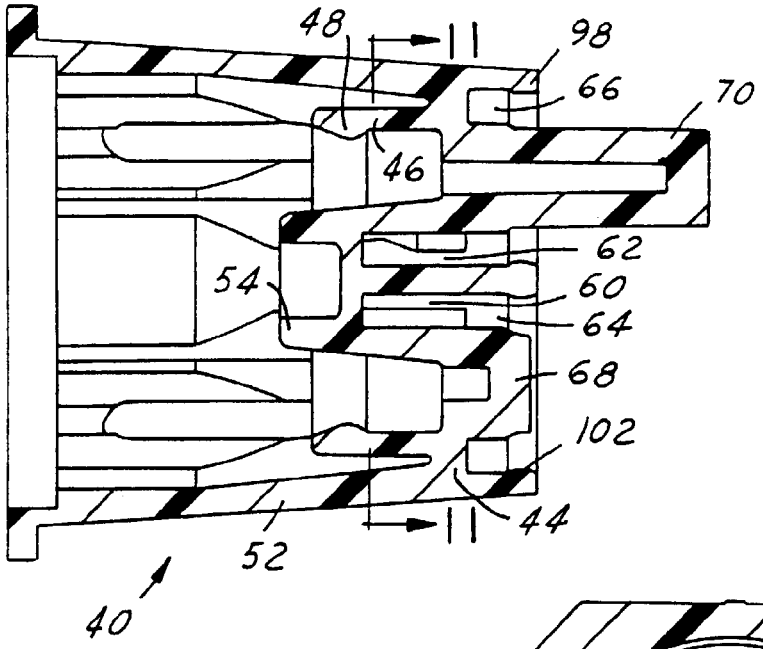
Figure 11:
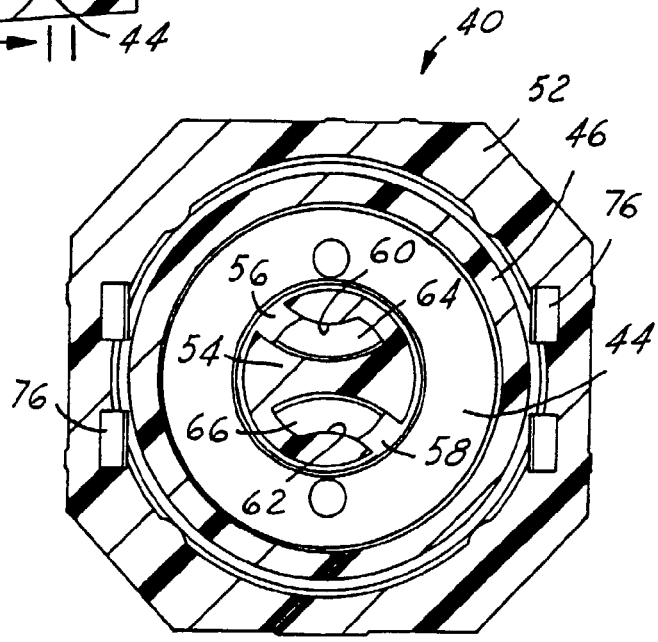
FIG. 11 is a sectional view taken substantially along the line 11—11 in FIG. 10.
Figure 12:
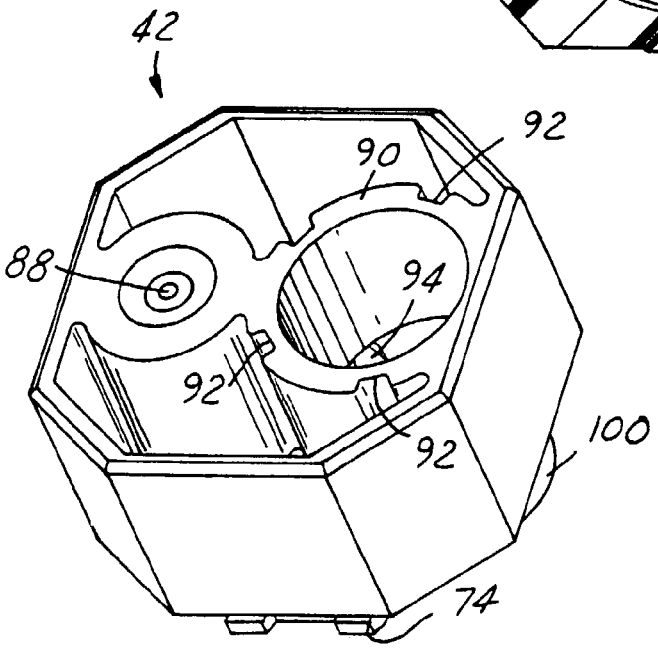
FIG. 12 is a perspective view of the nozzle insert in the nozzle of FIGS. 1 and 2.
Figure 13:
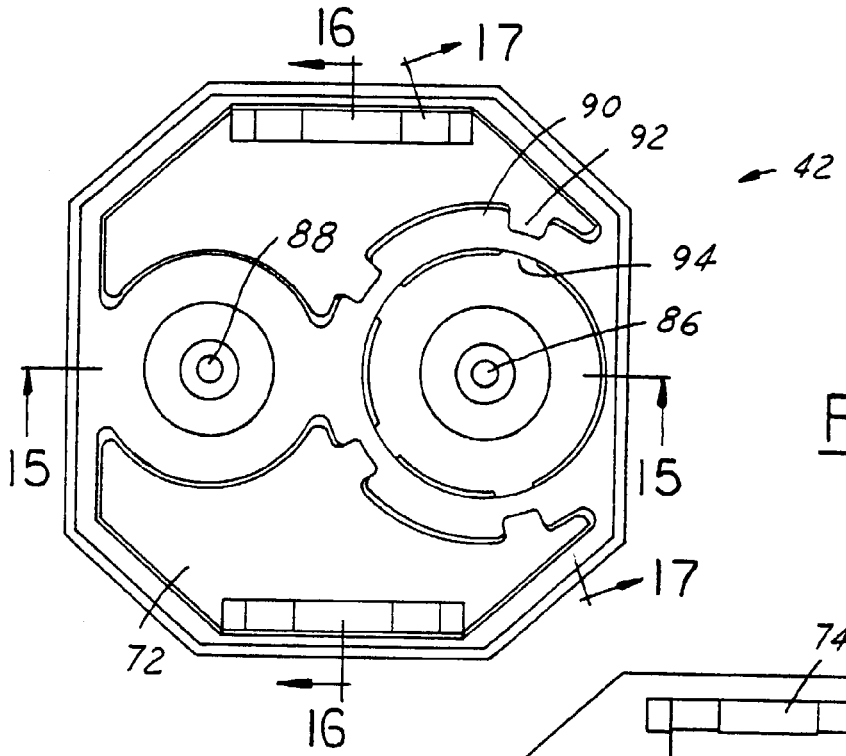
FIG. 13 is an elevational view of the outer end of the nozzle insert of FIG. 12.
Figure 14:
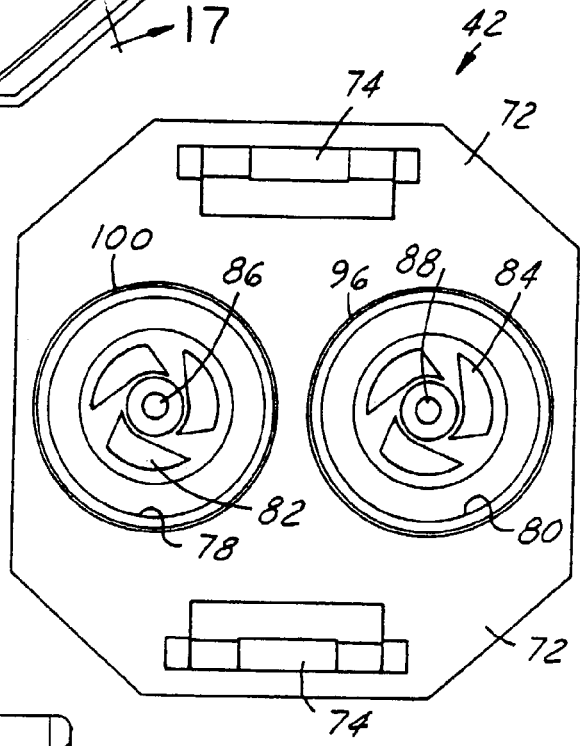
FIG. 14 is an elevational view of the inside of the nozzle insert in FIG. 12.
Figure 15:
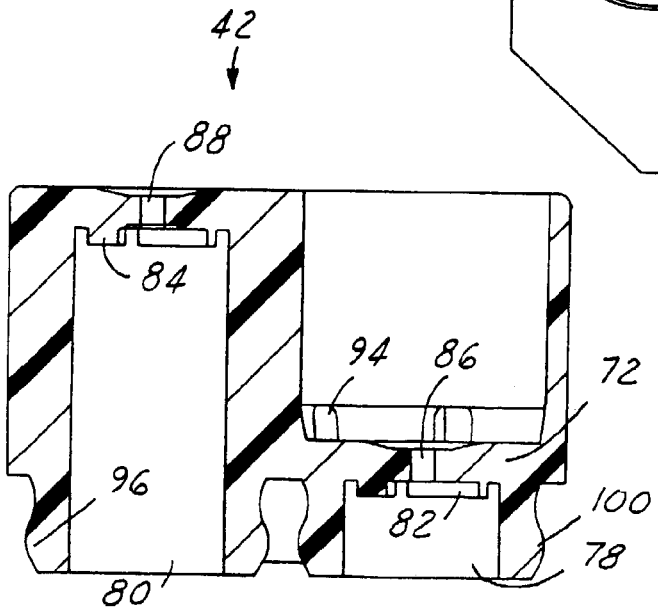
FIGS. 15, 16 and 17 are sectional views taken substantially along the respective lines 15—15, 16—16 and 17—17 in FIG. 13.
Figure 16:
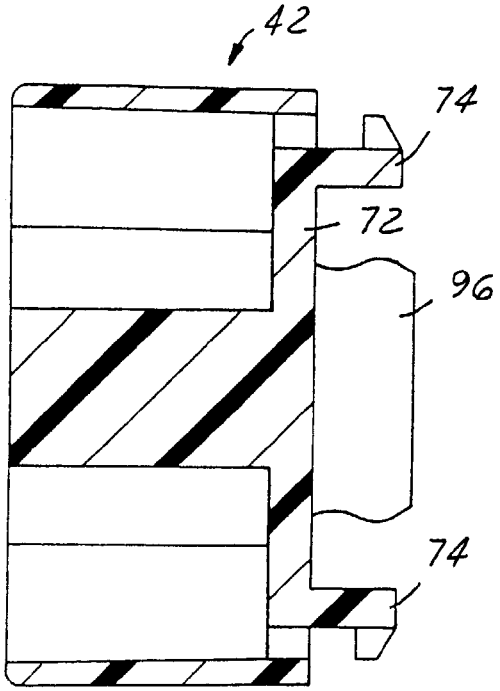
Figure 17:
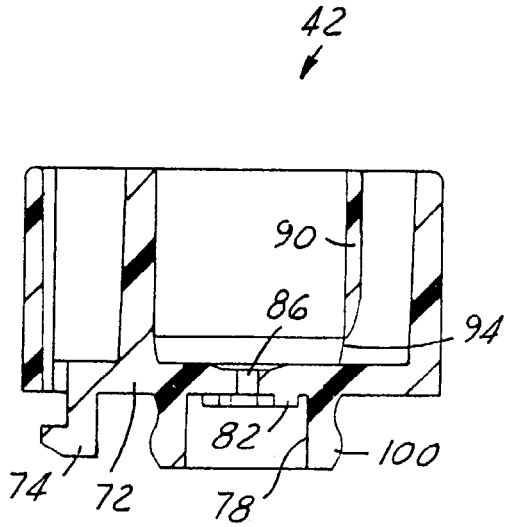

Nozzle 36 in the preferred embodiment of the invention is a two-piece assembly that includes a nozzle body 40 rotatably mounted on the end of barrel 32, and a nozzle insert 42 non-rotatably mounted on the end of nozzle body 40. Nozzle body 40 (FIGS. 1 and 2) is illustrated in detail in FIGS. 5–11, and includes an end wall 44. A collar 46 extends from end wall 44, and has an internal bead 48 for securing nozzle body 40 by snap fit over an external shoulder 50 (FIGS. 2 and 4) at the end of barrel 32 such that end wall 44 covers the end of the barrel, as best seen in FIG. 2. A skirt 52 extends from the outer periphery of end wall 44. A plug 54 centrally extends from end wall 44 coaxially with skirt 46, and is rotatably closely received within the open end of barrel 32 (FIG. 2). Plug 54, which is coaxial with the axis of rotation of nozzle 36 on barrel 32, has a pair of diametrically positioned openings or windows 56, 58 that open at the radially facing side surface of plug 54, as best seen in FIGS. 9 and 11. A pair of passages 60, 62 respectively extend from windows 56, 58 through end wall 44, and are connected to a respective pair of chambers 64, 66 disposed on the outer surface of end wall 44. As best seen in FIG. 11, passages 60, 62 are arcuate as viewed from the axial direction. As best seen in FIG. 3, slot 38 in barrel 32 is positioned 45° clockwise from a vertical position as viewed from the outer end of the barrel. Windows 56, 58 in plug 54 are likewise positioned at angles of 45° and 135° counterclockwise from the vertical as illustrated in FIG. 11. (The angles themselves are not critical, but must be coordinated as will be described.) A post 68 extends from end wall 44 within chamber 64. The outer end of post 68 terminates adjacent to the outer end of skirt 52. A second post 70 extends axially outwardly from wall 44 within chamber 66 beyond the outer end of skirt 52.

Figure 18A:
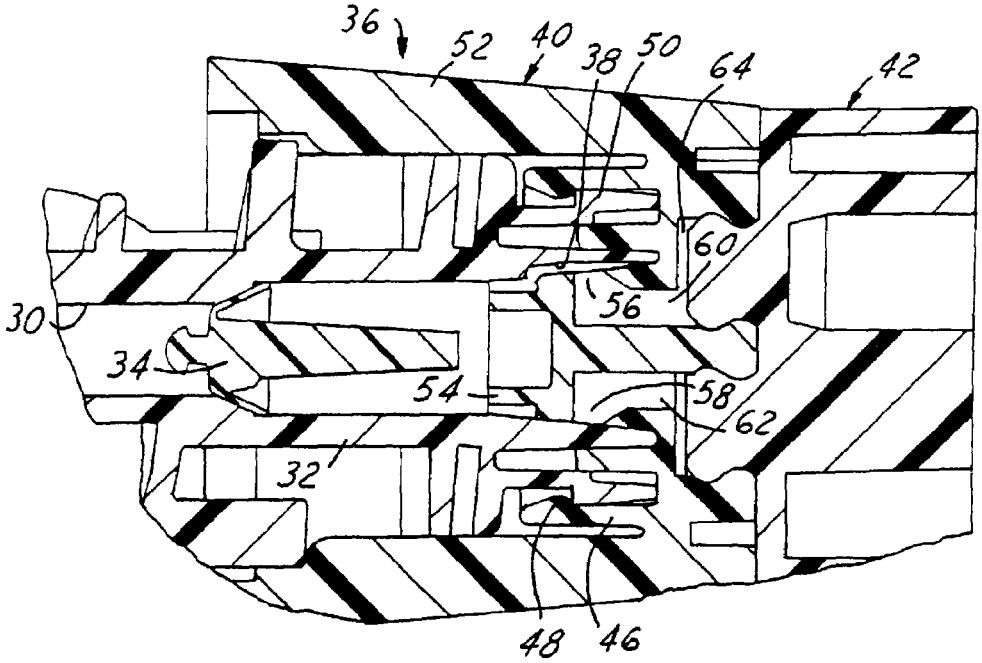
FIGS. 18A and 18B are sectional views that illustrate positioning of the nozzle on the barrel for dispensing fluid in one pattern in accordance with the present invention.
Figure 18B:
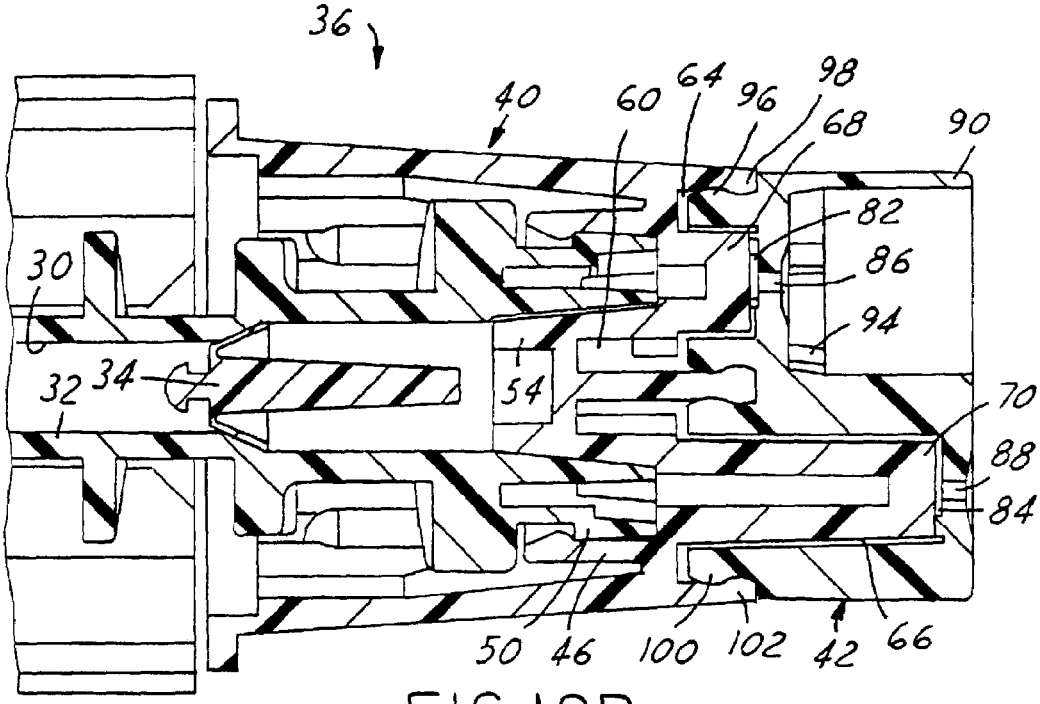

Nozzle insert 42 (FIGS. 1 and 2) is illustrated in detail in FIGS. 12–17. Nozzle insert 42 includes a base wall 72 having a pair of spring clips 74 extending therefrom for receipt in a corresponding pair of slots 76 (FIGS. 5 and 6) on nozzle body 40. Nozzle insert 42 is thus removably secured to the outer end of nozzle body 40. A pair of pockets 78, 80 are formed on the inside face of nozzle insert 42—i.e., the face or end of the nozzle insert that engages the nozzle body in assembly. A fluid brake 82, 84 is disposed at the base of each respective pocket 78, 80 for imparting a swirl motion to the fluid passing therethrough to the associated outlet opening 86, 88 at the base of each pocket. In assembly of nozzle insert 42 over nozzle body 40, post 68 in chamber 64 of nozzle body 40 is received in pocket 78 of nozzle insert 42, and post 70 in chamber 66 of nozzle body 40 is received in pocket 80 of nozzle insert 42. The ends of the respective posts are disposed closely adjacent to brakes 82, 84, as best seen in FIGS. 18B and 19B. A cylindrical collar 90 surrounds fluid outlet 86 for generating a foam discharge pattern to fluid flowing through outlet opening 86. Channels 92 along the outer periphery of collar 90 communicate with radial passages 94 (FIGS. 12, 13 and 15) at the base of collar 92 for feeding air to the foam discharge from outlet 86, and thereby enhancing the foaming action of the fluid. Indicia are molded or otherwise provided at 90° spacing around the outer surface of nozzle body skirt 52 to include OFF, SPRAY, OFF and FOAM rotational positions of the nozzle with respect to the sprayer body.

FIG. 2 illustrates operation of nozzle 30 in an OFF position of the nozzle. Specifically, fluid in barrel passage 30 and slot 38 is blocked by an imperforate portion of plug 54 of nozzle body 40, so that there is no fluid discharge from the nozzle if trigger 28 (FIG. 1) is pulled. FIGS. 18A and 18B illustrate operation when nozzle 36 is rotated 90° from the position of FIG. 2 to generate a FOAM outlet pattern. Fluid from barrel passage 30 flows past check valve 34 and through slot 38 to window 56, passage 60 and chamber 64 in nozzle body 40. From chamber 64, the fluid flows around post 68 to brake 82 in pocket 78, which is adjacent to the end face of post 68, and thence through outlet opening 86 in nozzle insert 42. Post 68 effectively reduces the volume of chamber 64. Opposed beads 96, 98 (FIGS. 10, 15 and 18B) around the annular wall that defines pocket 78 and the annular wall that defines chamber 64 reduce leakage of fluid through the interface between the nozzle body and the nozzle insert. Fluid is thus fed through outlet opening 86 in a wide pattern that impinges upon the inner surface of collar 90, which imparts a foam pattern to the dispensed fluid. Air fed to the fluid as it is dispensed, through air openings 94 in collar 90, enhances this generation of a foam fluid pattern.

Figure 19A:
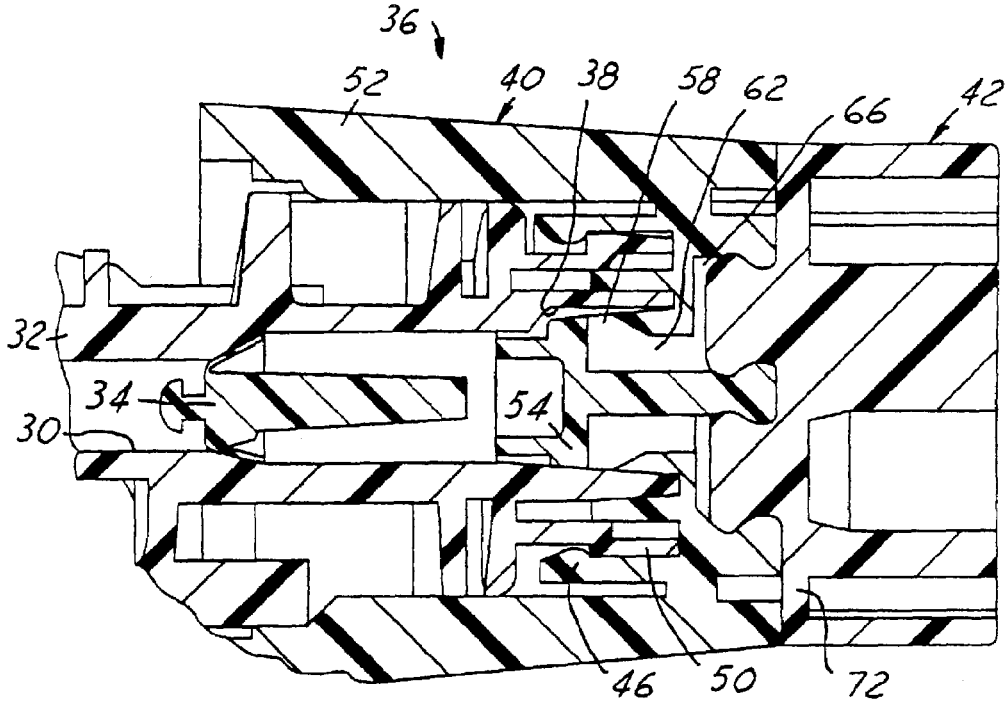
FIGS. 19A and 19B are sectional views that illustrate positioning of the nozzle on the trigger sprayer barrel for dispensing fluid in a second dispensing pattern in accordance with the present invention.
Figure 19B:
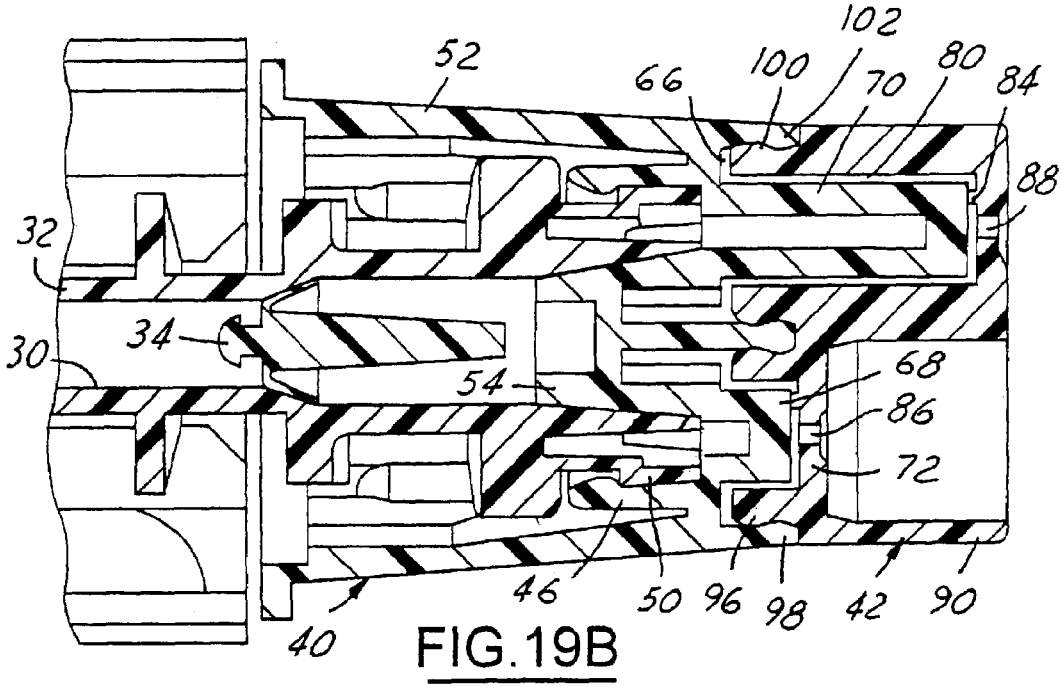

Rotation of nozzle 36 on barrel 32 from the OFF position of FIG. 2 to the position of FIGS. 19A and 19B generates a SPRAY outlet fluid pattern. The angular position of nozzle 36 on barrel 32 in FIGS. 19A and 19B is 180° from the positions of the nozzle body and insert in the FOAM outlet position of FIGS. 18A and 18B. In the SPRAY position of FIGS. 19A and 19B, fluid flowing from barrel passage 30 past check valve 34 and into slot 38 is fed through window 38 and passage 62 to chamber 66 in nozzle body 40, and thence around post 70 through pocket 80 and brake 84 to outlet 88 in nozzle insert 42. Again, post 70 functions to reduce the volume of chamber 66 and pocket 80. Fluid exiting outlet 88 is in a spray pattern. Opposed beads 100, 102 (FIGS. 10, 15 and 19B) around the respective annular walls that surround pocket 78 and chamber 64 reduce leakage of fluid.

Nozzle 36 in accordance with the present invention thus provides enhanced flexibility and economy for adapting the nozzle to differing outlet patterns. In particular, a single nozzle body 40 can be used in combination with differing nozzle inserts 42 for achieving differing spray patterns. This reduces tooling costs associated with nozzle manufacture, and can provide enhanced flexibility for a packager or a consumer where differing nozzle inserts can be used with a single nozzle body for achieving differing patterns with differing liquids or in differing applications. The pattern of the foam discharge can be varied by providing nozzle inserts with foam cylinders 90 of differing diameters and lengths. The sizes of air openings 94 can be varied among nozzle inserts, or the air openings can be deleted entirely, for achieving differing desired foam discharge characteristics. The invention has been disclosed in conjunction with a presently preferred embodiment, and a number of modifications and variations have been discussed. Other modifications and variations will readily suggest themselves to persons of ordinary skill in the art in view of the foregoing description. The invention is intended to embrace all such modifications and variations as fall within the spirit and broad scope of the appended claims.

The invention claimed is:

1. A trigger sprayer that includes:

a sprayer body having a barrel with an internal fluid passage, and open end and an internal axial slot in a wall of said passage adjacent to said open end, and a nozzle mounted on said barrel over said open end for rotation between diametrically positioned dispensing positions and diametrically positioned off positions, said nozzle having a plug received in said open end of said barrel passage, said plug having diametrically positioned windows for selective registry with said slot in said barrel passage, said windows in said plug being connected in fluid communication with axially extending fluid passages formed in said nozzle, said fluid passages communicating with laterally spaced fluid outlets in on said nozzle, an insert mounted on an outer end of said nozzle, said fluid outlets being on said insert and having differing dispensing patterns such that fluid is dispensed selectively in said patterns when said nozzle is rotated on said barrel to bring one or the other of said windows into registry with said slot, and fluid dispensing being blocked when said nozzle is rotated on said body to bring both of said windows out of registry with said slot.

2. A trigger sprayer that includes:

a sprayer body having a barrel with an internal fluid passage, an open end and an internal axial slot in a wall of said passage adjacent to said open end, and a nozzle mounted on said barrel over said open end for rotation between diametrically positioned dispensing positions and diametrically positioned off positions, said nozzle having a plug received in said open end of said barrel passage, said plug having diametrically positioned windows for selective registry with said slot in said barrel passage, said windows in said plug being connected within said nozzle to laterally spaced fluid outlets in said nozzle, said fluid outlets having differing dispensing patterns such that fluid is dispensed selectively in said patterns when said nozzle is rotated on said barrel to bring one or the other of said windows into registry with said slot, and fluid dispensing being blocked when said nozzle is rotated on said body to bring both of said windows out of registry with said slot, said nozzle includes a nozzle body rotatable on said barrel and including said plug and said windows, and a nozzle insert mounted on said nozzle body and including said laterally spaced fluid outlets coupled to said windows.

3. The sprayer set forth in claim 2 wherein said nozzle body has an end wall that overlies said open end of said barrel, said plug being disposed on an inner surface of said end wall.

4. The sprayer set forth in claim 3 wherein said nozzle body has fluid chambers on an outer surface of said end wall and passages through said end wall from said windows to said chambers.

5. The sprayer set forth in claim 4 wherein said nozzle body has an axis of rotation on said barrel, and said chambers are disposed on laterally opposed sides of said axis.

6. The sprayer set forth in claim 2 wherein said nozzle insert is removably secured by snap fit on an end of said nozzle body.

7. A trigger sprayer that includes:

a sprayer body having a barrel with an internal fluid passage, an open end and an internal axial slot in a wall of said passage adjacent to said open end, and a nozzle mounted on said barrel over said open end for rotation between diametrically positioned dispensing positions and diametrically positioned off positions, said nozzle having a plug received in said open end of said barrel passage, said plug having diametrically positioned windows for selective registry with said slot in said barrel passage, said windows in said plug being connected within said nozzle to laterally spaced fluid outlets in said nozzle, said fluid outlets having differing dispensing patterns such that fluid is dispensed selectively in said patterns when said nozzle is rotated on said barrel to bring one or the other of said windows into registry with said slot, and fluid dispensing being blocked when said nozzle is rotated on said body to bring both of said windows out of registry with said slot, said nozzle includes a nozzle body rotatable on said barrel and including said plug and said windows, and a nozzle insert mounted on said nozzle body and including said laterally spaced fluid outlets coupled to said windows, said nozzle body has a flow directing post in each of said chambers, and wherein said nozzle insert has a pocket received over each of said posts, said fluid outlets in said nozzle insert communicating with said pockets.

8. The sprayer set forth in claim 7 wherein said posts and said pockets are of differing axial dimension.

9. The sprayer set forth in claim 8 wherein a first of said posts received in a first of said pockets has a longer axial dimension than a second of said posts received in a second of said pockets, a first of said outlets communicating with said first pocket delivering a spray fluid outlet pattern and a second of said outlets communicating with said second pocket delivering a foam fluid outlet pattern.

10. The sprayer set forth in claim 9 wherein said nozzle insert includes a collar surrounding said second outlet for promoting generation of said foam fluid outlet pattern.

11. The sprayer set forth in claim 10 wherein said nozzle insert includes air slots in said collar for assisting generation of said foam pattern.

12. A trigger sprayer that includes:

a sprayer body having a barrel with an internal fluid passage, an open end and an internal axial slot in a wall of said passage adjacent to said open end, a nozzle body mounted on said barrel over said open end for rotation about an axis, said nozzle body having a plug within said open end of said fluid passage with open windows on said plug for selective registry with said slot and passages extending from said windows to a front of said nozzle body, and a nozzle insert mounted on said nozzle body for rotation with said body around said axis, said nozzle insert having fluid outlet openings that register with said passages in said nozzle body, said nozzle insert being constructed to dispense fluid through said outlet openings in differing fluid patterns as a function of rotation of said nozzle body around said axis.

13. The sprayer set forth in claim 12 wherein said windows comprise two windows in said plug positioned diametrically from each other across said axis, and said outlet openings in said nozzle insert comprise two outlet openings positioned diametrically from each other across said axis.

14. The sprayer set forth in claim 13 wherein said nozzle body and nozzle insert are constructed such that one of said fluid patterns is a spray pattern and the other of said fluid patterns is a foam pattern.

15. The sprayer set forth in claim 13 wherein said nozzle insert is removably mounted on said nozzle body such that said differing fluid patterns may be varied by use of differing nozzle inserts on said nozzle body.

16. The sprayer set forth in claim 12 wherein said nozzle body has an end wall that overlies said open end of said barrel, said plug being disposed on an inner surface of said end wall.

17. The sprayer set forth in claim 16 wherein said nozzle body has fluid chambers on an outer surface of said end wall and passages through said end wall from said windows to said chambers.

18. A trigger sprayer that includes:

a sprayer body having a barrel with an internal fluid passage, an open end and an internal axial slot in a wall of said passage adjacent to said open end, a nozzle body mounted on said barrel over said open end for rotation about an axis, said nozzle body having a plug within said open end of said fluid passage with open windows on said plug for selective registry with said slot and passages extending from said windows to a front of said nozzle body, and a nozzle insert mounted on said nozzle body for rotation with said body around said axis, said nozzle insert having fluid outlet openings that register with said passages in said nozzle body, said nozzle insert being constructed to dispense fluid through said outlet openings in differing fluid patterns as a function of rotation of said nozzle body around said axis;

said nozzle body has a flow directing post in each of said chambers, and wherein said nozzle insert has a pocket received over each of said posts, said fluid outlets in said nozzle insert communicating with said pockets.

19. The sprayer set forth in claim 18 wherein a first of said posts received in a first of said pockets has a longer axial dimension than a second of said posts received in a second of said pockets, a first of said outlets communicating with said first pocket delivering a spray fluid outlet pattern and a second of said outlets communicating with said second pocket delivering a foam fluid outlet pattern.

20. The sprayer set forth in claim 19 wherein said nozzle insert includes a collar surrounding said second outlet for promoting generation of said foam fluid outlet pattern.

21. The sprayer set forth in claim 20 wherein said nozzle insert includes air slots in said collar for assisting generation of said foam pattern.

* * * * *